US006591083B2

(12) United States Patent
Rohde

(10) Patent No.: US 6,591,083 B2
(45) Date of Patent: Jul. 8, 2003

(54) DIGITAL IMAGE RECORDING DEVICE AND METHOD FOR FIXATION OF TONER ON AN IMAGE CARRIER SUBSTRATE

(75) Inventor: Domingo Rohde, Kiel (DE)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/022,950

(22) Filed: Dec. 17, 2001

(65) Prior Publication Data

US 2002/0122681 A1 Sep. 5, 2002

(30) Foreign Application Priority Data

Dec. 22, 2000 (DE) ..... 100 64 563

(51) Int. Cl.[7] ..... G03G 15/20
(52) U.S. Cl. ..... 399/336
(58) Field of Search ..... 215/216; 399/67, 399/69, 70, 335, 336; 430/106, 110

(56) References Cited

U.S. PATENT DOCUMENTS 6,427,061 B1 * 7/2002 Miura et al. ..... 399/336

FOREIGN PATENT DOCUMENTS

DE 198 57 044 A1 4/2000

* cited by examiner

*Primary Examiner*—Hoang Ngo
(74) *Attorney, Agent, or Firm*—Lawrence P. Kessler

(57) ABSTRACT

A digital image recording device and a method wherein a color toner image (11) is initially transferred to an image carrier substrate (1) and then melted and fixed by exposure to electromagnetic radiation on the image carrier substrate (1). The method is characterized by the toner layers (5, 7, 9), having different colors, being melted in succession, toner image (11) being exposed repeatedly to electromagnetic radiation with different wavelength ranges, and that the corresponding wavelength range being chosen so that one color absorbs most of this electromagnetic radiation.

12 Claims, 1 Drawing Sheet

DIGITAL IMAGE RECORDING DEVICE AND METHOD FOR FIXATION OF TONER ON AN IMAGE CARRIER SUBSTRATE

FIELD OF THE INVENTION

The invention concerns a digital image recording method and device, in which a color toner image is transferred to an image carrier substrate and then melted and fixed by exposure to electromagnetic radiation on the image carrier substrate

BACKGROUND OF THE INVENTION

A known digital recording method is electrostatic printing, in which a latent electrostatic image is developed by charged toner particles. These are transferred to an image receiving substrate, hereafter substrate for short. The developed image transferred to the substrate is then fixed, the toner particles being melted by supplying heat.

Contacting methods are often used to melt the toner particles, in which the toner particles are brought into contact with corresponding devices, for example, hot rolls or rollers. A shortcoming here is that the design, maintenance and operating costs of these contact heating devices are demanding and therefore cost intensive. The use of silicone oil as parting agent is also required, which is supposed to prevent adhesion of the melted toner to the heating device. The error rate caused by the contact heating devices is also relatively high.

For fixation of the toner transferred, for example, to paper, contactless heating devices and methods are also known, in which the toner particles are melted by means of heat/microwave radiation or with hot air, so that they adhere to the paper.

The toner image in color printing can have four toner layers of different color, in which the toner layers are ordinarily black, yellow, magenta and cyan. The maximum density of each toner layer on the image carrier substrate is 100%, so that a maximum total density of the toner layers/toner image of 400% is obtained. The density of the toner image ordinarily lies in a range from 10% to 400%. A toner layer with only 10% density is primarily formed by individual toner particles on the image carrier substrate. Since the density of the toner image can vary in a range from 10% to 400%, it has proved to be extremely difficult to melt the toner image by means of a UV radiation device that exposes the toner image to ultraviolet radiation. The reason for this is that the energy for melting of a toner image with a toner density of 10% in a toner image with a toner density of 400% leads to blistering within the toner layers, because of air inclusions and moisture emerging from the image carrier substrate and the toners. Moreover, the energy to melt the toner image with a toner density of 400% is not sufficient to melt the toner image with a toner density of 10%.

UV radiation, whose wavelength range is so wide that all color toners of the toner image absorb sufficient energy for melting, can be used to melt a toner image having a density of 400%. A shortcoming here is that the energy distribution of the absorbed energy in the overlapping toner layers is very different, for example, the first, uppermost toner layer reflects about 5% and absorbs about 80% of the radiation energy, whereas the second toner layer, lying beneath the first toner layer, absorbs only about 15% of the radiation energy. The high energy input into the uppermost toner layer of the toner image is the reason, in known image recording methods, that the so called blistering (bubble formation in the toner image) occurs in high density toner layers, which affects the luster of the toner image in undesired fashion.

SUMMARY OF THE INVENTION

It is therefore the task of the invention to provide a method and device of the type, in which sufficient melting of the toner image can be guaranteed even at high densities of the toner layers. At the same time, blistering within the toner layers should be preferably fully prevented, but at least reduced to a harmless degree.

To solve the task, a digital recording method is proposed wherein a color toner image, having at least two, preferably four, toner layers of different color, be transferred to an image carrier substrate. The image carrier substrate can be formed, for example, from a sheet or continuous web, consisting of paper or cardboard. After all toner layers have been transferred in known fashion to the image carrier substrate, the toner image is exposed in a subsequent process step to electromagnetic radiation, so that the toner layers are melted on the image carrier substrate and fixed because of this. The method is characterized by the toner layers with different colors are melted in succession. For this purpose, the toner image is repeatedly exposed to electromagnetic radiation with a different wavelength range, the corresponding wavelength range being chosen so that, in each case, one color absorbs most of this electromagnetic radiation. An advantage of the method according to the invention is that, because of layered melting of the toner image, heating of the image carrier substrate is only relatively limited, so that the water removal rate from the image carrier substrate is strongly reduced. Blistering in the toner layers can be practically ruled out because of this.

In a preferred variant, it is proposed that the toner image for each of the process colors, cyan, magenta and yellow be exposed at least once to electromagnetic radiation with different wavelength ranges. The corresponding wavelength range is adjusted to the color of the melting toner layer, so that this absorbs most of the radiation in comparison with each of the other colors of the toner image. The intensity and duration of the radiation is chosen so that the toner layer is also melted in the desired fashion, while the other toner layers are just preheated. The other color toners can optionally also absorb part of the electromagnetic radiation that is actually not intended for them at all, in which the corresponding absorption rate is lower, preferably much lower, than the rate in the toner layer that is supposed to be melted.

An advantageous variant of the process is characterized by the toner image has four toner layers of different color, and that the toner image is exposed a total of three times to electromagnetic radiation with different wavelength ranges each time. It is proposed according to the invention that separate exposure to different wavelength ranges be carried out only to melt the magenta, cyan and yellow toner layers, whereas the black toner layer is not exposed separately. The reason for this is that the black toners have such good absorption behavior in all wavelength ranges for the other different colored toner layers that exposure of the magenta, cyan and yellow toner layers is sufficient in order to heat the black toner to or above its melting or glass transition point.

According to a modification of the invention, it is proposed that the radiation energy in each of the melting processes be high enough that the toner layer is also melted at low density. The electromagnetic radiation therefore has a high enough radiation energy from the outset that both toner layers with a high density, for example, 100%, and those with low density, for example, 10%, can be uniformly melted. Determination of the corresponding toner density to adjust the radiation energy is not necessary here, which simplifies control of the image recording process.

In a preferred variant, the radiation energy for a toner layer of the toner image with a density of 10% to 100% is equally large. In this practical example, the lowest possible density of a toner layer is therefore used as a basis to determine the radiation energy required for melting of this toner layer. This means that, if the radiation energy is sufficient to melt a toner layer with a density of 10%, this radiation energy is also sufficient for toner layers having a density of up to 100%.

Alternatively, to solve the task, a digital image recording device is also proposed, which is an electrographic or electrophotographic printer or copier, having a fixation device for fixation of a toner image on an image carrier substrate, in which the image carrier substrate is ordinarily conveyed past the fixation device by a conveyor device. The device is characterized by the fixation device for each toner layer, having one of the process colors cyan, magenta or yellow, has a radiation unit, by means of which electromagnetic radiation in a specific wavelength range can be applied to the toner image. A separate radiation unit is therefore prescribed for each of these process colors, in which the wavelength of its electromagnetic radiation applied to the toner image is adjusted to the corresponding process color, so that this absorbs most of the radiation relative to the other toner colors. The advantages arising from this are that overheating of the toner image and image carrier substrate can be ruled out.

In conjunction with the present invention, "radiation unit" is understood to mean a heating unit to heat the toner image for fixation on the image carrier substrate, which transfers the required heat to the toner image without mechanical contact with the toner image or image carrier substrate, exclusively by electromagnetic radiation for fixation.

In principle, there is a possibility of additionally providing another radiation unit expressly for the black toner, in addition to the radiation units for the other color toners. However, since black toner exhibits a very large wavelength exhibits very good absorption behavior in a very large wavelength range and the wavelength ranges of the radiation for the toner layers with the process colors cyan, magenta and yellow lie within the wavelength range of the black toner, a separate radiation unit for the black toner can preferably be dispensed with. This is then melted by at least one of the other radiation units.

As a further alternative, a digital image carrier device is characterized by the fixation unit has exclusively one radiation unit, the wavelength range of its electromagnetic radiation being variable during melting of the toner image. The wavelength range is varied as a function of the color of the toner image, so that only one of the toner colors absorbs most of the radiation. This means that the toner image is exposed several times in succession to electromagnetic radiation in different wavelength ranges, so that the toner layers are not melted simultaneously, but in succession. Because of this, overheating of the toner image and image carrier substrate can be practically ruled out with a simultaneously simpler and therefore more cost effective design.

BRIEF DESCRIPTION OF THE DRAWINGS

In the detailed description of the preferred embodiments of the invention presented below, reference is made to the accompanying drawings, in some of which the relative relationships of the various components are illustrated, it being understood that orientation of the apparatus may be modified. For clarity of understanding of the drawings, some elements have been removed, and relative proportions depicted or indicated of the various elements of which disclosed members are composed may not be representative of the actual proportions, and some of the dimensions may be selectively exaggerated.

DETAILED DESCRIPTION OF THE PREFERRED EMBODIMENTS

The image recording device described below is generally employable. It can be equipped, for example, as a printer or copier operating according to the electrographic or electrophotographic process. A multicolor toner image transferred to an image carrier substrate, having several liquid or dry toners of different color, can be melted by the image recording device according to the invention for fixation of the toner image on the image carrier substrate. Image recording devices of the type discussed here are known, in principle, so that their design and function is not taken up further.

Figure 1:
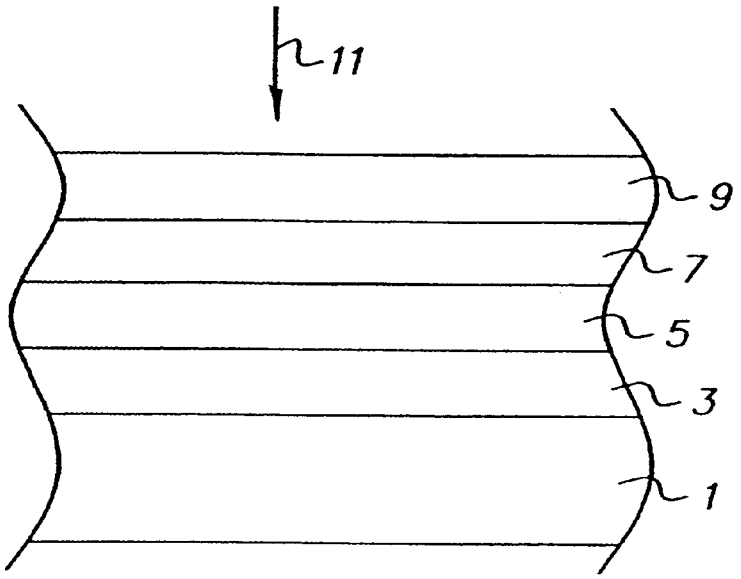
FIG. 1 shows a section from a toner image with several toner layers transferred to an image carrier substrate.

FIG. 1 shows a section of a practical example of an image carrier substrate 1, on which toner layers 3, 5, 7 and 9 are applied. As is apparent from FIG. 1, the toner layers 3 to 9 lie one above the other. A first toner layer 3, which is applied directly to the image carrier substrate 1, has the color black. The second toner layer 5 lying above it has the color yellow, the third toner layer, the color magenta and the uppermost, fourth toner layer, the color cyan. All toner layers 3 to 9 together produce a toner image 11. The arrangement of toner layers 5, 7 and 9 is arbitrarily variable without difficulty, which means the uppermost toner layer of the toner image 11 can also be the yellow toner layer or the magenta toner layer. However, in all practical examples, the toner layer applied directly to the image carrier substrate 1 is preferably the black toner.

Experiments were conducted, in which the toner image 11 was exposed to electromagnetic radiation with different wavelength ranges. The toner layers 3 to 9 of toner image 11 were then arranged one above the other, as described with reference to FIG. 1. The effective surface covering for absorption of radiation in an unfixed toner layer, having a density of 100%, is about 70%. In all experiments, the wavelength for fixation of yellow toner was in a range from 420 nm to 460 nm, for magenta toner in a range from 510 nm to 555 nm and, for cyan toner, in a range from 630 nm to 670 nm.

The absorption percentage of toners of different color that are already melted is shown in Table 1 at different wavelength ranges of the electromagnetic radiation. The values shown in Tables 1 to 4 were rounded off and are therefore considered guidelines. It is apparent from Table 1 that the absorption behavior of the melted black toner layer is unaltered in a wavelength range from 420 nm to 670 nm, whereas the melted yellow, magenta and cyan toner layers have distinct differences in absorption behavior in the individual wavelength ranges.

TABLE 1

| Wavelength for fixation of color toner layers | Absorption of a melted black toner layer | Absorption of a melted yellow toner layer | Absorption of a melted magenta toner layer | Absorption of a melted cyan toner layer |
|---|---|---|---|---|
| Yellow: 420 nm–460 nm | 80% | 80% | 30% | 30% |
| Magenta: 510 nm–550 nm | 80% | 30% | 90% | 30% |
| Cyan: 630 nm–670 nm | 80% | 10% | 0% | 80% |

The degree of absorption of the unfixed toner layers (70% coverage) for the four colors and the three to four mentioned wavelength ranges of the electromagnetic radiation for melting of the different colors are shown in Table 2. It is apparent that the toner layers in the unmelted state have a distinctly poorer absorption behavior than in the melted state, as a comparison of Tables 1 and 2 show.

TABLE 2

| Wavelength for fixation of color toner layers | Absorption of an unmelted black toner layer | Absorption of an unmelted yellow toner layer | Absorption of an unmelted magenta toner layer | Absorption of an unmelted cyan toner layer |
|---|---|---|---|---|
| Yellow: 420 nm–460 nm | 56% | 56% | 21% | 21% |
| Magenta: 510 nm–550 nm | 56% | 21% | 63% | 21% |
| Cyan: 630 nm–670 nm | 56% | 7% | 0% | 56% |

The degree of reflection of the electromagnetic radiation from the unfixed, i.e., unmelted, toner layer is apparent from Table 3. It is apparent that the reflection is about 5% in a wavelength range from 420 nm to 670 nm.

TABLE 3

| Wavelength for fixation of color toner layers | Reflection of black toner layer | Reflection of yellow toner layer | Reflection of magenta toner layer | Reflection of cyan toner layer |
|---|---|---|---|---|
| Yellow: 420 nm–460 nm | 5% | 5% | 5% | 5% |

TABLE 3-continued

| Wavelength for fixation of color toner layers | Reflection of black toner layer | Reflection of yellow toner layer | Reflection of magenta toner layer | Reflection of cyan toner layer |
|---|---|---|---|---|
| Magenta: 510 nm–550 nm | 5% | 5% | 5% | 5% |
| Cyan: 630 nm–670 nm | 5% | 5% | 5% | 5% |

The energy distribution of the electromagnetic radiation in different wavelength ranges in a toner image having a density of 400% is apparent from Table 4. 400% toner image is understood to mean that this toner image is formed by a black, yellow, magenta and cyan toner layer, lying one above the other, the density of each toner layer amounting to 100%.

TABLE 4

| Wavelength for fixation of color toner layers | Energy absorption of black toner layer | Energy absorption of yellow toner layer | Energy absorption of magenta toner layer | Energy absorption of cyan toner layer | Reflection |
|---|---|---|---|---|---|
| Yellow: 420 nm–460 nm | 20% | 31% | 16% | 23% | 10% |
| Magenta: 510 nm–550 nm | 12% | 7% | 49% | 23% | 9% |
| Cyan: 630 nm–670 nm | 30% | 4% | 0% | 57% | 9% |

It is readily apparent from Table 4 that, with electromagnetic radiation of the toner image in a wavelength range from 420 nm to 460 nm, the yellow toner layer absorbs most of the electromagnetic radiation, namely, 31%. The magenta and cyan toner layers 7 and 9 that are penetrated by the radiation absorb a much smaller fraction of the radiation. At a wavelength length range from 510 nm to 550 nm, the degree of absorption of the magenta toner layer is greatest, whereas absorption of the cyan toner layer is only about half as large in comparison. Most of the electromagnetic radiation in a wavelength range from 630 nm to 670 nm is absorbed by the cyan toner layer.

The method according to the invention is apparent from the aforestated. It is characterized by different toner layers having different colors are melted in succession, the toner image being repeatedly exposed to electromagnetic radiation with different wavelength range. For example, the toner image is initially exposed to electromagnetic radiation in a wavelength range from 420 nm to 460 nm, so that only the yellow toner layer is initially melted. The magenta toner layer lying above it is then melted, the toner image being exposed to electromagnetic radiation with a wavelength of 510 nm to 550 nm. In a third process step, the uppermost cyan toner layer is then melted, the toner image being exposed to radiation in the wavelength range from 630 nm to 670 nm. For melting of the black toner layer, exposure of the toner image to an additional fourth process step is preferably not required, since the black toner layer already absorbed sufficient energy and was melted because of it by exposure of the toner image for melting of each of the other toner layers. If the energy absorbed by the black toner is not high enough, it is possible without difficulty to expose the toner image again to electromagnetic radiation in a separate fourth process step, in order to finally also melt the black toner.

The sequence in which the toner layers are melted is optional, in principle. Thus, the uppermost toner layer of the toner image can be melted and only then the toner layers lying beneath. This is easily accomplished by an appropriate control device coupled to the at least one radiation unit.

Figure 2:
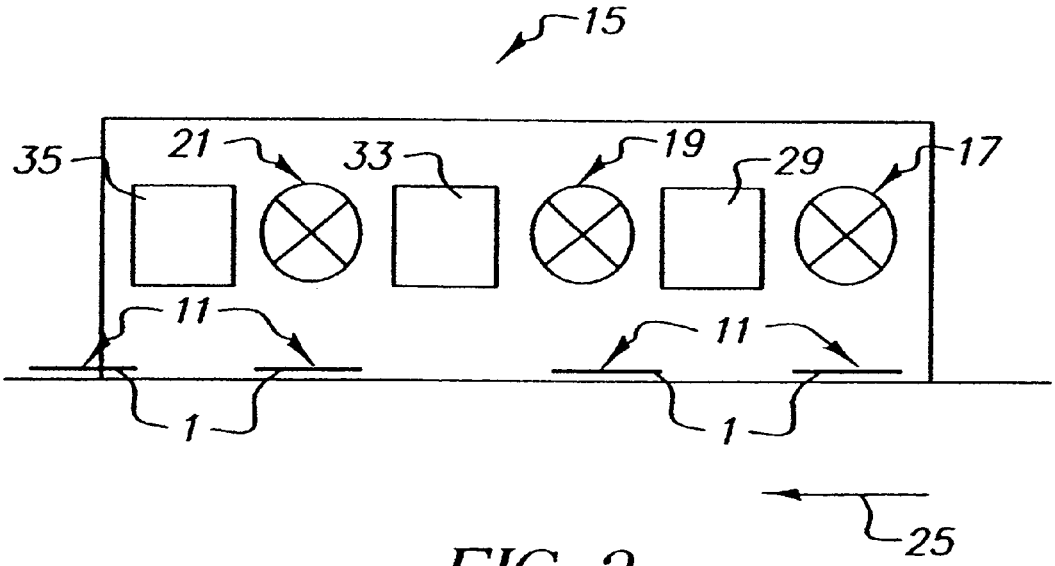
FIG. 2 serves as section of a practical example of the image recording device image carrier substrate.

FIG. 2 schematically shows a practical example of the digital image recording device 13, which includes a fixation unit 15 with separate radiation units 17, 19, 21. The radiation units 17, 19, 21 each have at least one halogen metal vapor lamp, which exposes the image carrier substrate 1 with the toner image 11 situated on it to electromagnetic radiation with different wavelengths when conveyed past the fixation unit 15 by a conveyor unit 23 (not further shown). The conveyor unit 25 of the image carrier substrate 1 is indicated with an arrow.

As is apparent from FIG. 2, the radiation units 17, 19, 21 are arranged at a spacing from each other in the transport direction 25 of image carrier substrate 1, a first cooling device 29 being arranged in a free state 27 between the first radiation unit 17 and the second radiation unit 19, and a second cooling device 33 being arranged in a free space 31 between the second radiation unit 19 and the third radiation unit 21. A third cooling device 35 is also arranged after the third and last radiation unit 21. The cooling devices 29, 33 and 35 serve to cool the toner image 11 and the image carrier substrate 1 after the preceding heating process, in order to avoid overheating of the image carrier substrate and/or toner image.

Use of cooling devices between the exposure steps can have advantages. In a preferred variant of the image recording device, however, no cooling devices are provided between the exposure devices. Preheating of the unmelted toner layers therefore occurs through the first exposure step, which is advantageous, since the required energy density of the last exposure step is reduced on this account. Overheating of the toner layer must then be able to be ruled out.

The radiation units 17 to 21 can expose the toner image for melting of the toner layers to at least one light flash or to continuous radiation. The patent claims filed with the application are wording proposals without prejudice to the achievement of additional patent protection. The applicant reserves the right to claim additional feature combinations, thus far only disclosed in the description and/or drawings.

The practical examples are not to be understood as a restriction of the invention. Numerous modifications are instead possible within the context of the present disclosure, especially variants, elements and combinations and/or materials that can be deduced, for example, by combination or modification of individual features or elements or process steps by one skilled in the art with reference to solution of the task, contained in the drawings and described in conjunction with the general description and variants, as well as the claims, and lead to a new object or to new process steps or sequences of process steps by combinable features.

The invention has been described in detail with particular reference to certain preferred embodiments thereof, but it will be understood that variations and modifications can be effected within the spirit and scope of the invention.

| Parts List | |
|---|---|
| 1 | Image carrier substrate |
| 3 | 1st toner layer |
| 5 | 2nd toner layer |

-continued

| Parts List | |
|---|---|
| 7 | 3rd toner layer |
| 9 | 4th toner layer |
| 11 | Toner image |
| 13 | Image recording device |
| 15 | Fixation unit |
| 17 | Radiation unit |
| 19 | Radiation unit |
| 21 | Radiation unit |
| 23 | Conveyor device |
| 25 | Conveyor device |
| 27 | Free space |
| 29 | 1st cooling device |
| 31 | Free space |
| 33 | 2nd cooling device |
| 33 | 3rd cooling device |

What is claimed is:

1. Digital image recording method, in which a color toner image (11) is transferred to an image carrier substrate (1) and then melted and fixed on image carrier substrate (1) by exposure to electromagnetic radiation, characterized by the toner layers (3, 5, 7, 9) having different colors being melted in succession, toner image (11) being exposed repeatedly to electromagnetic radiation with different wavelength ranges, and the corresponding wavelength range being chosen so that, in each case, one color absorbs most of said electromagnetic radiation of such respective wavelength.

2. Image recording method according to claim 1, characterized by a toner image (11), for each of the process colors cyan, magenta and yellow, being exposed at least once to electromagnetic radiation with a respective different wavelength range.

3. Image recording method according to claim 2, characterized by a toner image (11) having four toner layers (3, 5, 7, 9) of different color, and that the toner image (11) is exposed a total of three times to electromagnetic radiation with different wavelength ranges.

4. Image recording method according to claim 2, characterized by, for melting of yellow toner (5), the toner image (11) being essentially exposed to electromagnetic radiation in a wavelength range from 420 nm to 460 nm.

5. Image recording method according to claim 2, characterized by, for melting of magenta toner (7), the toner image (11) being exposed essentially to electromagnetic radiation in a wavelength range from 510 nm to 550 nm.

6. Image recording method according to claim 2, characterized by, for melting of cyan toner (9), the toner image (11) being exposed essentially to electromagnetic radiation in a wavelength range from 630 nm to 670 nm.

7. Image recording method according to claim 2, characterized by the radiation energy in each of the melting processes being high enough that the toner layer (3, 5, 7, 9) is melted even with low density.

8. Image recording method according to claim 2, characterized by the radiation energy for toner layers (3, 5, 7, 9) with a density of 10% to 400% being equally large.

9. Digital image recording device (13), especially electrographic or electrophotographic printer or copier, with a fixation unit (15) for fixation of a toner image (11) on an image carrier substrate (1), in which said fixation unit (15) has at least one radiation unit (17, 19, 21) for exposure of the toner image (11) to electromagnetic radiation, characterized by said radiation unit (17, 19, 21) for each toner layer (5, 7, 9), respectively having the process colors cyan, magenta or yellow, by which electromagnetic radiation can be applied to the toner image (11) in a specific, adjustable wavelength range for each respective process color toner layer.

10. Image recording device according to claim 9, characterized by said radiation units (17, 19, 21) being arranged one behind the other in the transport direction (25) of the image carrier substrate (1) conveyed past the fixation unit (13).

11. Image recording device according to claim 10, characterized by a cooling unit (29, 33) for cooling of the toner image (11) being arranged at least between the first and second radiation units (17, 19) and between the second and third radiation units (19, 21).

12. Image recording device according to claim 9, characterized by each radiation unit (17, 19, 21) having at least one halogen metal vapor lamp.

* * * * *